US005950998A

United States Patent [19]

Crabb

[11] Patent Number: 5,950,998

[45] Date of Patent: Sep. 14, 1999

[54] PORTABLE CABLE VISE

[76] Inventor: Michael R. Crabb, 1646 N. Yucca, Chandler, Ariz. 85224

[21] Appl. No.: 08/975,165

[22] Filed: Nov. 20, 1997

[51] Int. Cl.[6] ..... B25B 13/52

[52] U.S. Cl. ..... 269/98

[58] Field of Search ..... 269/98, 97, 249, 269/156, 902, 269, 270

[56] References Cited

U.S. PATENT DOCUMENTS

| | | | |
|---|---|---|---|
| 904,234 | 11/1908 | Sievert | 269/269 |
| 1,009,609 | 3/1911 | Wenneborg | 269/97 |
| 2,778,393 | 1/1957 | Golasowski | 269/97 |

*Primary Examiner*—David A. Scherbel
*Assistant Examiner*—Daniel G. Shanley
*Attorney, Agent, or Firm*—John D. Lister

[57] ABSTRACT

A portable cable vise can be mounted on the edge of a horizontally or vertically extending tailgate, the upper edge of the sidewall of cherry-picker personal bucket, and other support structures in the field. The vise has a lower stationary jaw member and an upper movable jaw member and a means for moving the upper jaw member vertically toward and away from the stationary jaw member to grip a cable between the jaw members. The lower jaw member has an upwardly opening cable receiving recess therein and the upper jaw member has a downwardly opening cable receiving recess therein for gripping the outer surface of a cable without crushing or damaging the cable. The vise includes a generally C-shaped mounting clamp with a clamping means for gripping a support adjacent its edge to secure the mounting clamp to the support. The vise can be secured to the mounting clamp to maintain the vise in a generally vertical orientation regardless of whether the mounting clamp is secured to the edge of a horizontally or vertically extending support.

3 Claims, 2 Drawing Sheets

FIG. 1
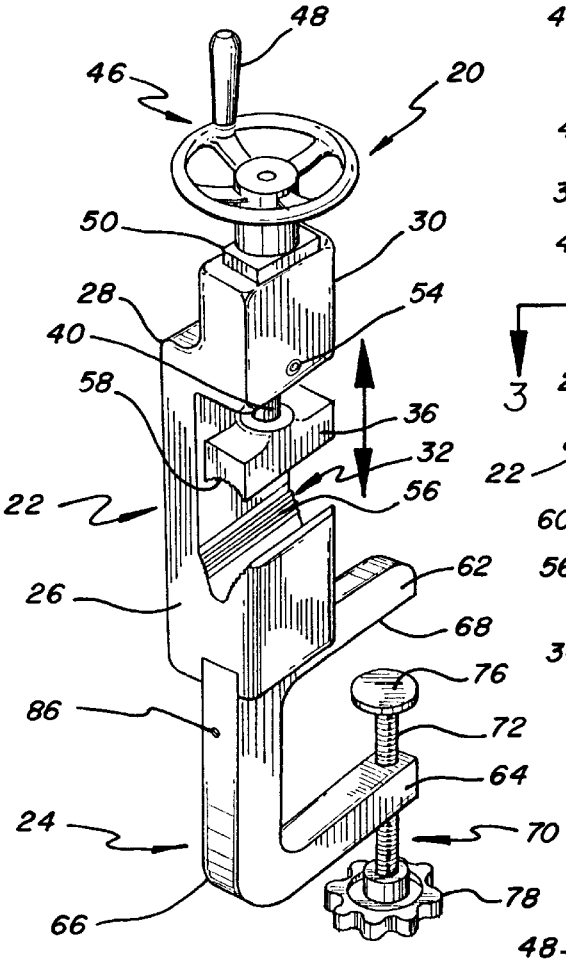
FIG. 2
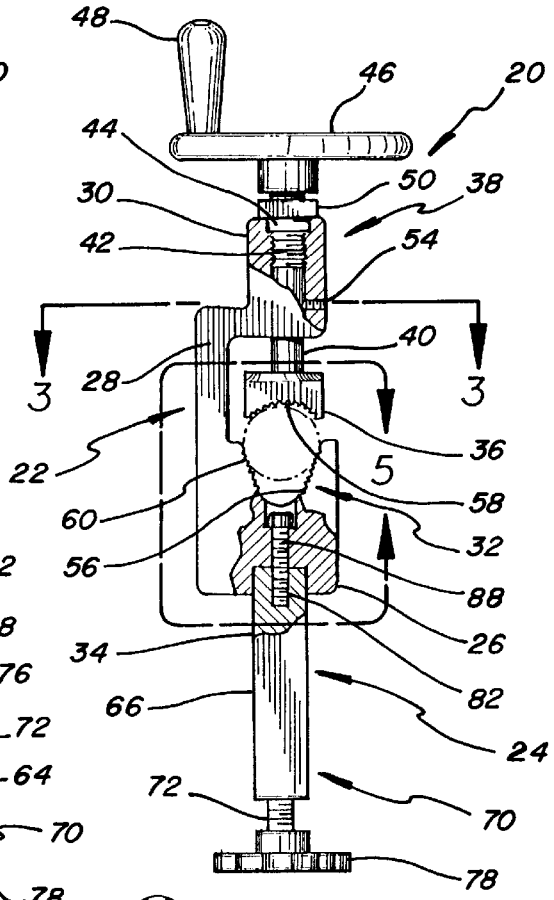
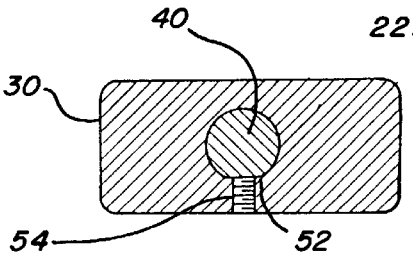
FIG. 3
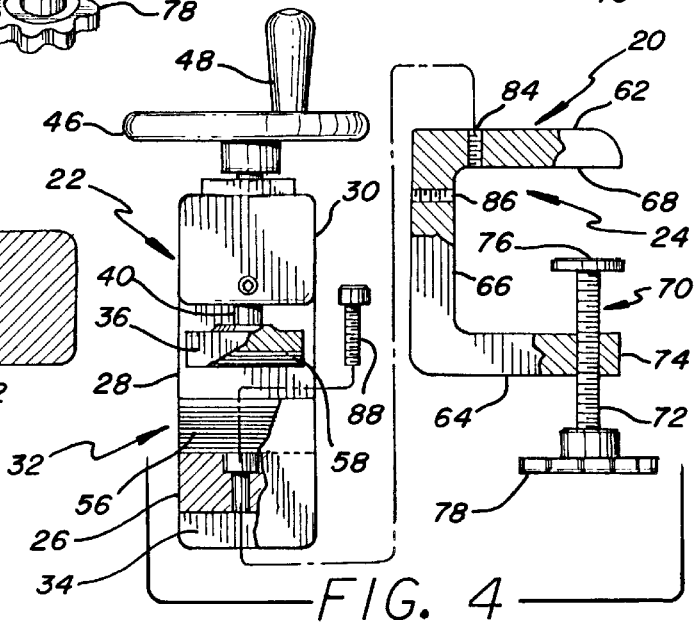
FIG. 4

FIG. 6
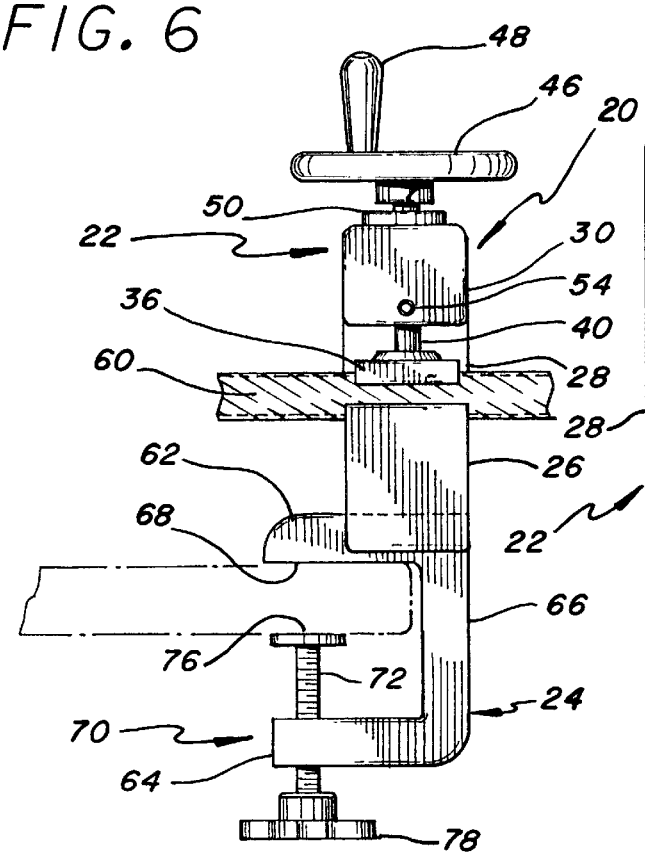
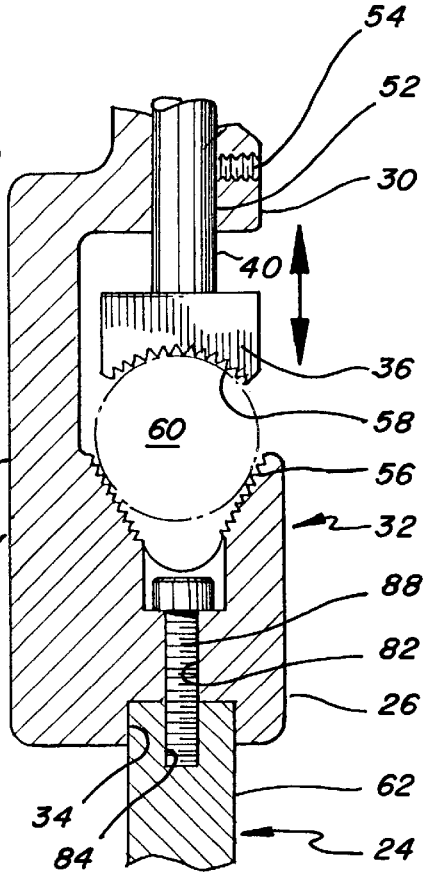
FIG. 5
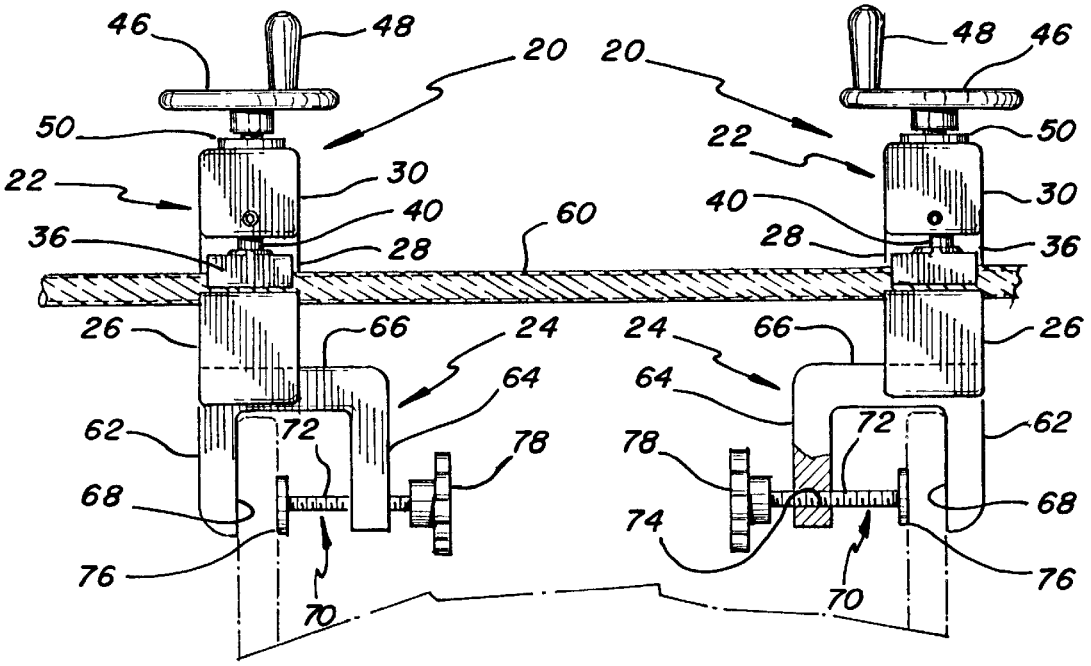
FIG. 7

PORTABLE CABLE VISE

BACKGROUND OF THE INVENTION

The present invention relates to portable vises and, in particular, to a portable cable vise, with jaws designed to grip cables without damaging the cables, that can be easily mounted on the edges of vertically and horizontally extending structures commonly found in the field, such as but not limited to vehicle tailgates, the upper edges of cherry-picker personnel buckets and the like, while maintaining the portable cable vise in an upright or vertical orientation to enable the workers to easily work with cables held in the vise.

Companies, such as but not limited to electrical utility companies, telephone companies, and cable television companies, often have a need to work on large diameter power cables, telephone cables, fiber optic cables and the like in the field. These cables typically range in diameter from about one half of an inch to about two and one quarter inches in diameter and may be either insulated or uninsulated. These cables are normally run underground or overhead between towers. Currently, when these cables are being installed or repaired in the field, the cables are manually held by the workers while the cables are being spliced, insulation is being stripped from the cables, etc. Handling these heavy, large diameter cables manually while the cables are being installed or repaired is an awkward process and can be dangerous when working with overhead cables many feet above the ground. In addition, when a cable is cut the ends of the spirally wound strands of the cable can unravel or spring open causing problems in handling and working with the cable. Thus, there has been a need to provide a means in the field to safely and effectively handle these large diameter cables without damaging the cables, especially fiber optic cables whose strands can be easily damaged by crushing the strands.

The portable cable vise of the present invention provides a solution to the above problems. The portable cable vise of the present invention can be easily, quickly and firmly mounted on different support structures commonly found in the field, such as but not limited to vehicle tailgates, the upper edges of cherry-picker personnel buckets, and the like, so that the portable cable vise can be used to grip cables when working with the cables on the ground or in the air. The portable cable vise can be mounted on the edge of a horizontally or vertically extending support structure while maintaining the vise in an upright position and the jaws of the vise are designed to accommodate cables of different diameters and firmly grip those cables without crushing the cable strands.

SUMMARY OF THE INVENTION

The portable cable vise of the present invention includes a vise and a mounting clamp that can be mounted on the edge of a horizontally or vertically extending tailgate, the upper edge of the sidewall of cherry-picker personal bucket, and other support structures in the field. The vise has a lower stationary jaw member and an upper movable jaw member and a means for moving the upper jaw member vertically toward and away from the stationary jaw member to grip a cable between the jaw members. The lower jaw member has an upwardly opening cable receiving recess therein, preferably with a generally V-shaped transverse contour, and the upper jaw member has a downwardly opening cable receiving recess therein, preferably with a generally arcuate transverse contour, for gripping the outer surface of a cable without crushing or damaging the cable. Preferably, the mounting clamp is a generally C-shaped mounting clamp with a clamping mechanism for gripping a horizontally or vertically extending support adjacent its edge to secure the mounting clamp to the support. The vise can be secured to the mounting clamp in either of two orientations at right angles to each other to maintain the vise in a generally vertical orientation regardless of whether the mounting clamp is secured to the edge of a horizontally or vertically extending support structure.

BRIEF DESCRIPTION OF THE DRAWINGS

FIG. 1 is a perspective view of the portable cable vise of the present invention.

FIG. 2 is a side elevation of the portable cable vise of FIG. 1.

FIG. 3 is a horizontal section through an upper portion of the portable cable vise taken substantially along lines 3—3 of FIG. 2.

FIG. 4 is an exploded view of the portable cable vise of FIG. 1, partially in section, and showing two mounting locations on the C-shaped mounting clamp for mounting the vise on the mounting clamp at orientations perpendicular to each other.

FIG. 5 is an enlarged view of the circled portion of FIG. 2, labeled 5.

FIG. 6 shows the portable cable vise mounted on the edge of a horizontally extending support structure, such as a tailgate.

FIG. 7 shows two portable cable vises mounted on the upper edges of vertically extending support structures, such as the sidewall of a cherry-picker personnel bucket.

DESCRIPTION OF THE PREFERRED EMBODIMENTS

As shown in FIGS. 1–5, the portable cable vise 20 of the present invention includes a vise 22 for gripping and holding the outer surface of a cable and a mounting clamp 24 for mounting the portable cable vise on the edge of a support structure. The vise 22 and the mounting clamp 24 are preferably made from cast aluminum to reduce the weight of the portable cable vise. However, if desired to the portable cable vise can be made of heavier metals.

The vise 22 includes a lower portion 26, an intermediate portion 28 and an upper portion 30. The lower portion 26 forms the stationary lower jaw member 32 of the vise 22 and includes a channel 34 for securing the vise 22 to the mounting clamp 24. The intermediate portion 28 extends vertically between the lower and upper portions of the vise 22 to join the lower and upper portions of the vise in a fixed, spaced apart relationship with the lower portion 26 of the vise directly beneath the upper portion 30 of the vise. The upper portion 30 of the vise carries a movable, upper jaw member 36 directly above the lower jaw member 32 and a screw drive mechanism 38, which passes vertically through the upper portion of the vise, for raising and lowering the upper jaw member 36 relative to the lower jaw member 32.

While other screw drive mechanisms can be used, in a preferred embodiment, the screw drive mechanism 38 includes a spindle 40, a screw drive 42 which is received in an internally threaded tubular upper portion of the spindle 40, a collar 44 for maintaining the screw drive 42 in a vertically stationary position while being rotated relative to the upper portion 30 of the vise 22, and a wheel 46 with a handle 48 for rotating the screw drive 44. The upper end of the screw drive 42 is secured to the wheel 46 so that when the wheel is rotated the screw drive 42 rotates with the wheel. An upper, unthreaded portion of the screw drive 42 passes through and is rotatably received within a vertical hole in a cover plate 50 bolted or otherwise secured to the upper surface of the upper portion of the vise. The collar 44, which may be a collar bearing to facilitate the rotation of the screw drive 42, is affixed to the upper unthreaded portion of the screw drive immediately below the cover plate 50 thereby maintaining the screw drive in a fixed vertical position relative to the upper portion of the vise when the screw drive is rotated by the wheel 46. The spindle 40 has a generally cylindrical outer surface except for a flat longitudinally extending surface 52 on one side that is engaged by a set screw 54 to keep the spindle from rotating. With this structure, when the wheel 46 is rotated in a first direction (typically clockwise when viewed from above) the rotation of the threaded portion of the screw drive 42 in the upper internally threaded tubular portion of the spindle 40 relative to the spindle moves the spindle 40 and the upper jaw 36 downward toward the lower jaw 32 and when the wheel 46 is rotated in a second direction (typically counter clockwise when viewed from above) the rotation of the threaded portion of the screw drive 42 in the upper internally threaded tubular portion of the spindle 40 relative to the spindle moves the spindle 40 and the upper jaw member 36 upward away from the lower jaw member 32.

The lower jaw member 32 is provided with an upwardly opening cable receiving recess 56 and the upper jaw member 36 is provided with a downwardly opening cable receiving recess 58 for gripping and holding cables between the jaw members without crushing or otherwise damaging the strands and/or the insulation of the cable. Preferably, the upwardly opening cable recess 56 is located directly beneath the downwardly opening cable recess 58 with the longitudinal axes of these recesses in alignment one above the other.

Preferably, one of the cable receiving recesses has a generally arcuate transverse surface contour and the other cable receiving recess has a generally V-shaped transverse surface contour (upright or inverted) for gripping and retaining cables of different diameters with the portable cable vise without damaging the cables. As best shown in FIG. 5, by having one cable receiving recess with a generally arcuate transverse surface contour and the other cable receiving recess with a generally V-shaped transverse contour, the generally cylindrical outer surface of a cable 60 is gripped between the jaw members 32 and 36 at three locations spaced about the periphery of the cable to firmly grip and retain the cable in the jaws of the portable cable vise. Thus, the outer diameter of the cable 60 that can be gripped and retained in the jaws of the portable cable vise 20 can vary over a range of diameters with the jaw members 32 and 36 being moved closer together for smaller diameter cables and farther apart for larger diameter cables. For example, in one preferred embodiment of the invention, the generally arcuate transverse surface contour of one recess has a radius of about two and one quarter inches and is about one and one half inches wide at its mouth; and the generally V-shaped transverse surface contour of the other recess is about two inches wide at its mouth by about three quarters of an inch in depth. These cable receiving recesses can be used to firmly grip and retain cables having outer diameters ranging from about one half of an inch to about two and one quarter inches without crushing or otherwise damaging the cables.

In the most preferred embodiment of the invention, the transverse surface contour of the lower jaw member 32 is generally V-shaped and the transverse surface contour to the upper jaw member 36 is generally arcuate. As shown in FIGS. 1,2 and 5, the surfaces of the recesses 56 and 58 may be provided with longitudinally extending ribs or other knurls to better grip the outer surface of the cable 60.

The mounting clamp 24 for mounting the portable cable vise 20 on the edges of various support structures in a workshop or in the field, preferably, is generally C-shaped with two arms 62 and 64 extending generally parallel with respect to each other and outward from one side of an intermediate portion 66 that joins the arms in a spaced apart relationship. The mounting clamp 24 has a clamping mechanism for securing the mounting clamp to the edge of a support structure having generally vertically or horizontally extending surfaces adjacent its edge by gripping the surfaces of the support structure adjacent the edge. In a preferred embodiment of the invention, the inner surface 68 of the arm 62 forms a stationary plate or jaw of the clamping mechanism and a screw drive clamping mechanism 70 mounted on the other arm 64 includes the moving plate or jaw of the clamping mechanism. As shown in FIGS. 1, 2 and 4, the screw drive clamping mechanism 70 has a threaded spindle 72 that passes through a threaded hole 74 in arm 64. The spindle 72 of the screw drive mechanism extends perpendicular to the inner surface 68 of the arm 62 and includes a plate or jaw member 76 (e.g. a circular plate) for engaging a support surface at one end, that opposes the inner surface of arm 62, and a knob or other means 78 for easily rotating the spindle 72 at the opposite end to move the plate or jaw member 76 either toward or away from the inner surface 68 of the arm 62 for clamping the mounting clamp 24 to the edge of a support structure. Preferably, the plate or jaw member 76 is mounted on a ball joint or other means that permits the plate or jaw member 76 to assume various angles relative to the end of the spindle 72 to better grip support surfaces that are irregular or have one side adjacent the support surface edge at an angle to the other side.

The vise 22 and the mounting clamp 24 include a means for mounting the vise to the mounting clamp in two orientations that preferably, are at right angles or perpendicular to each other. In a preferred embodiment the underside of the lower portion 26 of the vise 22 has the channel 34 therein that has an inner transverse surface contour that conforms to the outer transverse surface contour of the arm 62 and the intermediate portion 66 of the mounting clamp 24 so that the arm 62 and the intermediate portion 66 of the mounting clamp can be received within the channel 34. The lower portion 26 of the vise 22 has a vertically extending, unthreaded bolt hole 82 therein passing completely through the lower portion of the vise. Preferably, the bolt hole 82 extends from the apex or base of the generally V-shaped cable receiving recess 56 through to the channel 34 and is centered with respect to the channel 34. The mounting clamp 24 has a first threaded bolt hole 84 in the arm 62 and a second threaded bolt hole 86 in the intermediate portion 66 of the mounting clamp that is oriented or extends at right angles or substantially right angles to the first bolt hole 84. Preferably, both of the bolt holes 84 and 86 are adjacent the juncture of the arm 62 and the intermediate portion 66 and both of the bolt hole 84 and 86 extend perpendicular to the longitudinal centerlines of the arm 62 and the intermediate portion 66 respectively. To mount the vise 22 onto the mounting clamp 24, a bolt 88 is passed down through the unthreaded bolt hole 82 in the lower portion 26 of the vise 22 and is threaded into either bolt hole 84 or hole 86, depending on the orientation desired for the vise relative to the mounting clamp, to secure the vise 22 firmly and rigidly to the mounting clamp 24. Preferably, the upper end of the bolt hole 82 in the lower portion 26 of the vise 22 is countersunk to keep the head of the bolt 88 below the surface of the recess 56.

FIG. 6 shows the portable cable vise 20 of the present invention secured to or mounted on the edge of horizontally extending support structure 100, such as but not limited to a pickup truck tailgate. To retain the vise 22 in a vertical or substantially vertical orientation, the vise 22 is secured to the arm 62 of the mounting clamp 24 by threading the bolt 88 into the bolt hole 84 of arm 62. FIG. 7 shows a pair of the portable cable vises 20 secured to or mounted on the edge of a vertically extending support structure 102, such as but not limited to the upper edge of a personnel bucket of a cherry-picker. To retain the vise 22 in a vertical or substantially vertical orientation, the vise 22 is secured to the intermediate portion 66 of the mounting clamp 24 by threading the bolt 88 into the bolt hole 86 of the intermediate portion 86. Thus, the portable cable vise 20 of the present invention can be used by workers in the field, both on the ground and in the air, to splice or otherwise work on cables of various diameters without crushing or otherwise damaging the cables. While the portable cable vise 20 is primarily intended to be used in the field where there has been a need for such a device, the portable cable vise 20 can also be used in a workshop or other work facility. While the portable cable vise is specifically designed to be used for gripping and retaining cables without crushing or otherwise damaging the cables, the portable cable vise of the present invention can also be used to grip and hold other generally cylindrical workpieces, such as but not limited to, pipes, cylindrical bars, and tubular members.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A portable cable vise comprising:

a vise having a lower portion, an upper portion and an intermediate vertically extending portion joining the lower and upper portions with the upper portion located directly above and spaced from the lower portion;

the lower portion of the vise including a first, stationary jaw member; the jaw member having a first upwardly opening cable receiving recess therein for gripping the outer surface of a cable; the first upwardly opening cable receiving recess having a generally V-shaped transverse surface contour;

the upper portion of the vise having a vertically extending spindle mounted therein; the spindle having a lower end with a second jaw member mounted thereon that has a second downwardly opening cable receiving recess therein for gripping the outer surface of a cable; the second downwardly opening cable receiving recess having a generally concave arcuate transverse surface contour; the second downwardly opening recess of the second jaw member having a longitudinal axis in alignment with a longitudinal axis of the first upwardly opening recess in the first jaw member; and the upper portion of the vise including screw means for moving the spindle and the second jaw member vertically relative to the upper portion of the vise toward and away from the first jaw member of the lower portion of the vise to grip a cable within the recesses of the first and second jaw members;

a generally C-shaped mounting clamp secured to and carrying the vise; the mounting clamp having a pair of spaced apart arms joined by an intermediate portion; the intermediate portion extending at a generally right angle to the first and second arms; the spaced apart arms of the mounting clamp having clamping means for gripping surfaces of a support adjacent an edge of the support to secure the mounting clamp to the support; and means for securing the vise to one of the spaced apart arms and to the intermediate portion of the mounting clamp whereby the mounting clamp can be secured to supports with vertically extending surfaces adjacent the edge and horizontally extending surfaces adjacent the edge while maintaining the vise in a generally vertical orientation; the means for securing the vise comprising a vertically extending bolt hole in the lower portion of the vise passing completely through the lower portion of the vise; a first threaded bolt hole in one of the arms of the mounting clamp extending transversely into the one arm; a second threaded bolt hole in the intermediate portion of the mounting clamp extending transversely into the intermediate portion of the mounting clamp; and a bolt which passes through the bolt hole in the lower portion of the vise and is threaded into one of the first and the second threaded bolt holes in the mounting clamp.

2. The portable cable vise according to claim 1, wherein: the surfaces of the first and second recesses are knurled to better grip the outer surface of a cable.

3. The portable cable vise according to claim 1, wherein: the underside of the lower portion of the vise has a channel therein which fits over the mounting clamp.

* * * * *